US012342916B1

(12) United States Patent
Rojo

(10) Patent No.: US 12,342,916 B1
(45) Date of Patent: Jul. 1, 2025

(54) MECHANICAL SYSTEM FOR FOLDING AND UNFOLDING SUITCASE WHEELS

(71) Applicant: Héctor Lorenzo Rojo, Cabrales (ES)

(72) Inventor: Héctor Lorenzo Rojo, Cabrales (ES)

( * ) Notice: Subject to any disclaimer, the term of this patent is extended or adjusted under 35 U.S.C. 154(b) by 0 days.

(21) Appl. No.: 18/990,954

(22) Filed: Dec. 20, 2024

(51) Int. Cl.
*A45C 5/14* (2006.01)
*A45C 5/03* (2006.01)
*A45C 13/26* (2006.01)

(52) U.S. Cl.
CPC ..... *A45C 5/146* (2013.01); *A45C 5/03* (2013.01); *A45C 13/262* (2013.01); *A45C 2013/267* (2013.01)

(58) Field of Classification Search
CPC ..... A45C 5/146; A45C 5/03; A45C 13/262; A45C 2013/267
See application file for complete search history.

(56) References Cited

U.S. PATENT DOCUMENTS 6,507,975 B2 * 1/2003 Maupin ..... B60B 33/0057 16/34
7,360,784 B2 * 4/2008 Stewart ..... B60J 7/1614 280/30
9,764,751 B2 * 9/2017 Cho ..... A63B 55/30
11,110,948 B2 * 9/2021 Song ..... B62B 5/067
2018/0242702 A1 * 8/2018 Shah ..... A45C 15/00

OTHER PUBLICATIONS

Verage Foldaway 21, retreived from https://a.co/d/4MXbJ1y on Dec. 20, 2024.
Take Off Luggage 18 2.0, retrieved from https://a.co/d/6osejFV on Dec. 20, 2024.

* cited by examiner

*Primary Examiner* — Tri M Mai
(74) *Attorney, Agent, or Firm* — Mariana I. Vernieri

(57) ABSTRACT

A mechanical system for folding and unfolding suitcase wheels, designed to enhance durability and functionality. The system integrates a telescopic handle, a transmission mechanism, and pivoting wheel platforms to convert the vertical movement of the handle into a rotational motion that deploys or retracts the wheels. A spring mechanism ensures automatic retraction when the handle is lowered. The system is housed within a lower compartment of the suitcase, which includes an open floor allowing the wheels to extend outward when deployed and to remain concealed when retracted. This modular design is adaptable to various suitcase configurations, providing a compact, durable, and user-friendly solution for improving luggage maneuverability. The invention allows for compatibility with different transmission methods ensuring versatility and customization for different suitcase models.

2 Claims, 7 Drawing Sheets

MECHANICAL SYSTEM FOR FOLDING AND UNFOLDING SUITCASE WHEELS

TECHNICAL FIELD

This invention relates generally to the field of travel accessories. More specifically, the invention relates to a mechanical system for folding and unfolding suitcase wheels.

BACKGROUND OF THE INVENTION

In recent decades, we have witnessed a substantial growth in passenger transport on a global level, encompassing air, land, and maritime means. This phenomenon has been driven by globalization, technological advances, and economic expansion. The accessibility to various means of transport, from commercial airlines to high-speed trains and ferry systems, has facilitated an unprecedented movement of people. According to World Bank data, the number of passengers across all means of transport has grown exponentially, particularly in the last two decades, reflecting the increase in global trade, tourism, and greater connectivity between nations.

Air transport has been the fastest-growing sector. According to the International Air Transport Association (IATA), the number of air passengers reached 4.5 billion in 2019, a significant increase from 2.2 billion in 2005. This doubling of global air traffic in just 14 years has been driven by the proliferation of low-cost airlines, the expansion of international routes, and the modernization of airport infrastructure. According to the World Bank, the volume of passengers transported by commercial airlines worldwide was 4.376 billion in 2019, representing a 170% increase compared to the 1.615 billion recorded in 1995. Additionally, emerging markets such as Asia-Pacific, the Middle East, and Latin America have seen a considerable increase in passengers, driven both by domestic demand and the expansion of low-cost airlines. Later, in 2023, the air travel industry made an impressive comeback after the pandemic. Passenger traffic soared, surpassing 2019 levels for the first time in five years.

Rail and maritime transport have also shown considerable growth. According to the International Union of Railways, the number of passengers on high-speed trains in Europe and Asia grew by 15% annually between 2010 and 2019. Countries such as China and Japan are leading this growth, with rapidly expanding rail networks that transport millions of passengers each year. The Chinese railway system, for example, transported more than 2.7 billion passengers in 2019, while in Europe, rail transport accounted for nearly 9 billion trips in 2018, according to Eurostat.

As for maritime transport, the Cruise Lines International Association (CLIA) reports that more than 30 million passengers traveled on cruises in 2019, a significant increase compared to 17.8 million in 2009. This sector has grown, driven by the wider range of destinations and the demand for tourist experiences. Additionally, ferries remain a key option for inter-island transport and tourism, especially in the Mediterranean and Southeast Asia, where millions of people use these services each year.

One of the key aspects of passenger transport, whether by air, land, or sea, is baggage handling. Suitcases, in particular, have evolved from simple containers for belongings to fashion accessories that reflect travelers' lifestyles. However, baggage handling remains a challenge, especially in airports and train stations. Suitcase wheels are one of the elements that suffer the most damage due to the impacts and friction they are subjected to on conveyor belts, stairs, and during baggage handling in cargo holds and compartments.

The statistics on baggage loss and damage also highlight the magnitude of the problem. According to the International Air Transport Association (IATA), 24.8 million suitcases were lost or damaged worldwide in 2019, representing a rate of 5.57 suitcases per thousand passengers. Although this figure has decreased compared to previous years thanks to improvements in baggage tracking technology, the problem persists, especially on connecting flights. Suitcases with robust wheels tend to be heavier, which affects comfort and design, and a suitable balance between durability, lightness, and aesthetics has yet to be found. This leaves room for innovation in creating suitcases with more resistant and lighter components, particularly regarding the wheels. Damaged bags accounted for 13% the 26 million mishandled bags in 2022, that is around 3,380,000 damaged bags in a single year, most of which were damaged in the wheels.

According to a 2023 market study conducted by Grand View Research, the global luggage market size was estimated at USD 38.80 billion in 2023 and is expected to grow at a CAGR of 7.1% from 2024 to 2030. The demand for luggage has been steadily increasing due to several key factors and trends that reflect changes in consumer behavior and lifestyle preferences. Manufacturers face the challenge of improving the durability of wheels and other components without compromising design or excessively increasing the weight of suitcases. This market growth also reflects the increasing importance of baggage as an integral part of the travel experience, both from a functional and aesthetic perspective.

In this context, suitcases have evolved from being simple containers for belongings to becoming fashion accessories that reflect the style and status of travelers. However, one of the recurring problems in the transport of suitcases is damage to the wheels. These are especially vulnerable during the handling processes at airports, where suitcases go through conveyor belts, stairs, and manual handling in aircraft cargo holds. The wheels are one of the elements that deteriorate the most due to their constant exposure to impacts and friction. This creates a market need for innovative solutions that improve the durability of these components without compromising the product's aesthetics and functionality.

Suitcase wheels, though essential, are also the weakest point due to their constant exposure to rough handling. In today's market, suitcases with more robust wheels tend to be heavy, which detracts from the comfort and design desired by consumers.

Existing solutions have not managed to achieve a proper balance between durability, weight, and design, leaving room for the creation of innovative products that offer better protection for the wheels. The present invention aims to develop an innovative mechanical system that allows the folding and unfolding of the wheels within the body of the suitcase, protecting them when not in use. The system is linked to the telescopic mechanism of the handle of the suitcase, so that when the handle is activated to pull the suitcase, the wheels automatically unfold, and when the handle is retracted, the wheels fold back into the main structure, has not yet been achieved.

This approach has several key advantages: Protection of the wheels during transport, minimizing damage from handling; optimization of space and weight, ensuring that the system does not negatively affect the suitcase's capacity or significantly increase its weight; and ease of use, as it integrates with the suitcase handle, simplifying its operation without the need for additional mechanisms.

In today's market, there are several suitcases that offer reinforced wheels and other devices to improve durability, but none has implemented integrated protection systems for the wheels linked to the handle movement to activate a rotational motion which deploys or contracts the wheels. Some of the most popular solutions include: Verage Foldaway 21, which is a foldable suitcase with detachable wheels but without an automatic system, and Take Off Luggage 18 2.0: a suitcase which aims to overcome the limitations of current products by offering protection of the wheels during transport on airplanes and other means, preventing damage, lightness and functionality by optimizing the number of parts and materials involved in the system, and ease of use, allowing the mechanism to activate without additional effort from the user, but which does not offer an automatic system.

An automatic system which addresses the recurring issue of damage to suitcase wheels during handling at airports and stations, through the use of a retractable wheel system, integrated into the structure of the suitcase and activated through the telescopic handle, allowing the wheels to automatically unfold when the handle is raised and retract when the handle is lowered, would be an advancement to the field.

Even more so, if that system enhances the durability of the wheels without sacrificing aesthetics or significantly increasing the weight of the baggage, optimizing space and weight while ensuring ease of use and high durability, something that has not yet been achieved in the current market.

SUMMARY OF THE INVENTION

The mechanical system for folding and unfolding suitcase wheels herein disclosed features a fully integrated and automated retractable wheel system. This mechanism allows the wheels to hide within the structure of the suitcase when not in use, ensuring their protection during transport or storage. When the telescopic handle is extended, the wheels activate automatically, ideally offering smooth, multidirectional maneuverability thanks to the three-hundred-and-sixty-degree wheels, although other kinds of wheels can also be used. The system is modular and adaptable to different types of suitcases, from hard-shell models to fabric cases, providing a versatile and functional solution for travelers. The system includes a wheel mechanism which is contained within an open compartment integrated into the base of the suitcase. This lower compartment covers the wheels completely when they are contracted but exposes the lower part of the wheels when they are deployed, so that they can make contact with the floor. The mechanism is compatible with different suitcase sizes and wheels, adapting to various suitcase configurations, both large and small. This compatibility also enhances the system's modularity, ensuring that it can be customized according to user preferences. The chamber connects to the interior of the bag through a separator wall having two holes, for the passage of the telescopic handle tubes from the chamber to the main body. These telescopic handle tubes, when the handle is raised, transfer the upward movement of the handle to a pivoting movement of a rotating platform attached to the wheels, so that the wheels are automatically unfolded when the handle is raised. Conversely, when the handle is lowered, the rotating platform rotates the opposite way, retracting the wheels.

One way to achieve this is using two "wings" as support platforms for two the wheels each, screwed directly onto the wheels. These wings are connected to an L-shaped module that is attached to the telescopic handle of the suitcase, which slides between two rods. When this L-shaped module is lifted, the rotating platforms pivot, allowing the wheels to extend or retract. The structure of the system includes a frame that houses all these components: the rotating platforms, the L-shaped module, and the complete mechanism that enables the movement of the wheels. This design ensures that the wheels can be deployed and retracted in a controlled manner through the movement of the telescopic handle, making the mechanism functional and efficient for use in retractable suitcases. Other embodiments use different mechanisms to enable the rotational movement of the support platforms for the wheels directly from the lineal movement of the handle tubes. For example, using a simple pinion and rack mechanism to achieve the same motion without departing from the spirit and scope of the invention.

DETAILED DESCRIPTION OF THE INVENTION

Disclosed is a mechanical system for folding and unfolding suitcase wheels, activated by the up and down movement of the suitcase's telescopic handle. The system focuses on the design of a retractable wheel system that can be incorporated into specific suitcases prepared for it. It is a system that, although adaptable to a wide range of suitcases, will always require an adaptation phase for both the mechanism itself and the suitcase to ensure that both parts function efficiently. Although a model of suitcases with a lower compartment specially designed to incorporate the mechanism is hereby disclosed, it must be noted that other designs and integrations are possible without departing from the spirit and scope of the present invention. The design focuses on a module installed at the base of the suitcase, which allows the wheels to deploy and retract automatically with the help of the telescopic handle.

The system operates simply: by fully extending the telescopic handle, the user makes a small motion to lift the suitcase and activate the deployment of the wheels. This ensures that all four wheels are fully extended, allowing the user to move the suitcase effortlessly. To retract the wheels, the user simply releases the handle's "click" and lowers it. A torsion spring mechanism ensures that the wheels return to their original position in a controlled manner without the need for additional intervention. This efficient and streamlined process aims to maximize user comfort when using the system, optimizing both the functionality and durability of the retractable wheel mechanism.

The mechanism integrates without interfering too much with the usable space of the suitcase. Despite incorporating an advanced mechanical solution, the design is simple and free of electronic parts, making it accessible both from a production and maintenance perspective. Being a mechanical system based on springs and rods, the chances of failure are reduced, which increases the product's reliability in situations of intensive use.

Figure 1:
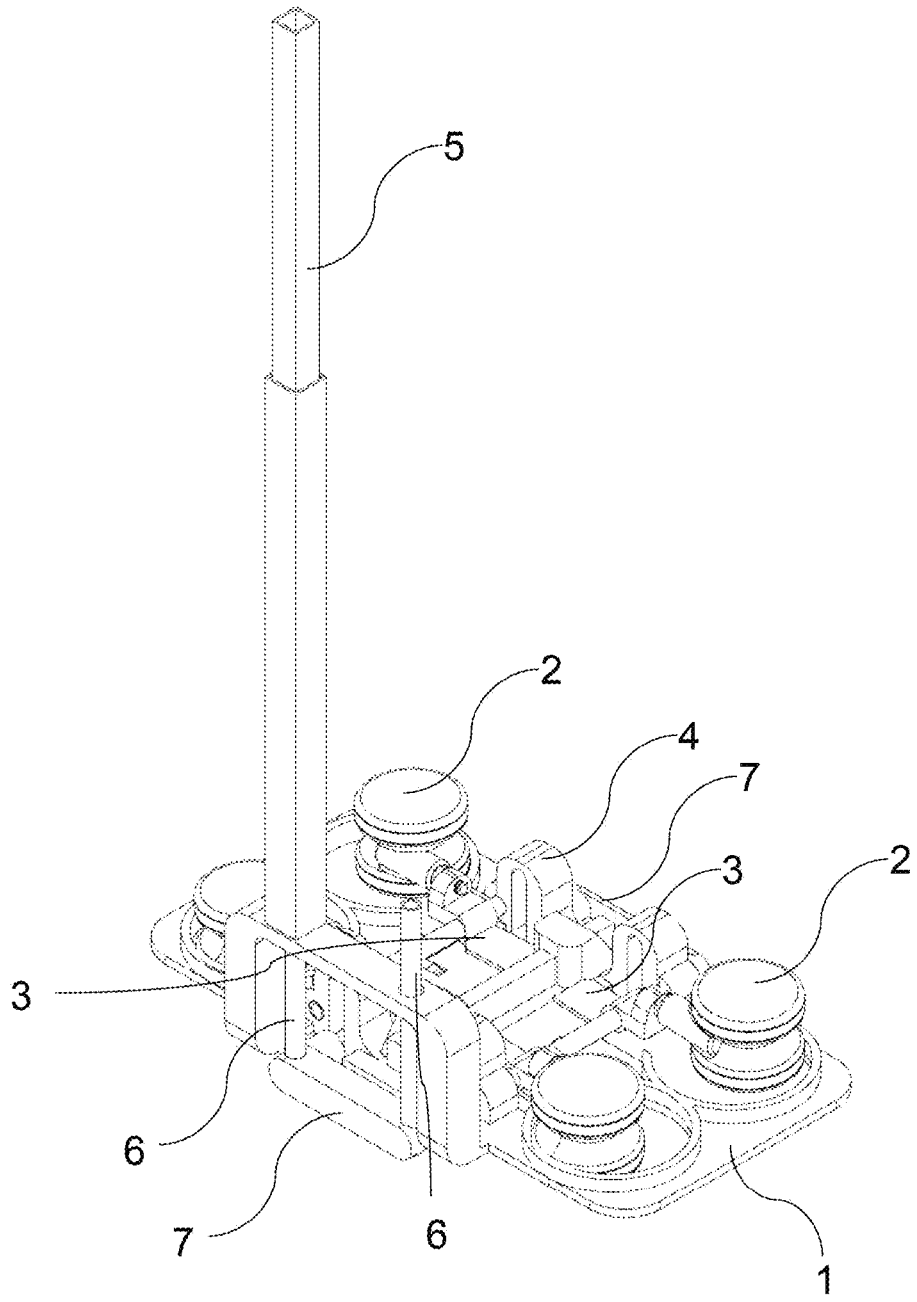
FIG. 1 is a perspective view of a mechanical system for folding and unfolding suitcase wheels in accordance with the present invention, where the wheels are folded.

FIG. 1 shows a view of the mechanical system for folding and unfolding suitcase wheels, isolated from the suitcase. This figure provides a detailed view of the mechanism that controls the deployment of the wheels.

A frame 1 acts as support of the mechanism, facilitating the integration of the wheels 2 to the rest of the structure, so that they can be folded and unfolded while maintaining a firm position when applied to a suitcase. The wheels 2 in some embodiments are swivel wheels, which can rotate three-hundred-and-sixty degrees, providing superior maneuverability. These wheels are designed to move easily in any direction, which is especially useful for travelers who need to navigate quickly in confined spaces, such as airports. Additionally, the mechanism is compatible with different suitcase sizes and wheels, allowing it to adapt to various suitcase configurations, both large and small. This compatibility also enhances the system's modularity, ensuring that it can be customized according to user preferences. The system has two rotating platforms 3, screwed directly onto the wheels. Although four is the most normal number of wheels for luggage nowadays, other embodiments have a different number of wheels, for example two wheels, and may use individual rotating platforms for each wheel. Each of these rotating platforms are connected to a horizontal tube 8 which forms an L-shaped module with the ascending tube 6, that is attached to the telescopic handle 5 of the suitcase, which slides between two rods 4. When these ascending tubes 6 are lifted, the rotating platforms 3 pivot, allowing the wheels 2 to extend or retract. In this figure, only one of the sides of the telescopic handle 5 is shown so that the ascending tube 6 can be better appreciated. The horizontal tubes 8 are not seen here as it is hidden below the rotating platforms 3 in this view. However, it is shown in other figures and it must be understood that each of them connects to the corresponding ascending tube 6 forming an "L" shape so that when this horizontal tubes 8 are lifted, they raise the loose part of rotating platform 3, which is attached on the other side to an axis that allows it to pivot, thereby rotating the rotating platform 3 so the wheels 2 are in the deployed position. In the shown embodiment there are two rotating platforms 3, each attached to a pair of wheels 2 (four wheels total), there are two telescopic handles 5, two L-shaped modules (6, 8) united by two ascending shafts 7, and four rods 4, two for each horizontal tube 8. When the tubes 6 are lowered, a spring system 9 causes the rotating platforms 3 and wheels 2 to return to their original position, as we will show in FIG. 7. It is also worth noting that two ascending shafts 7, one for each end of the horizontal tubes 8, keep these horizontal tubes 8 together, so that when they are lifted, they do it simultaneously, and following the vertical path allowed by the rods 4 that act as guides.

The overall structure of the system includes a base that houses all these components: the rotating platforms 3, the L-shaped modules (6, 7 and 8), and the complete mechanism that enables the movement of the wheels 2. This design ensures that the wheels 2 can be deployed and retracted in a controlled manner through the movement of the telescopic handle 5, making the mechanism functional and efficient for use in retractable suitcases.

Figure 2:
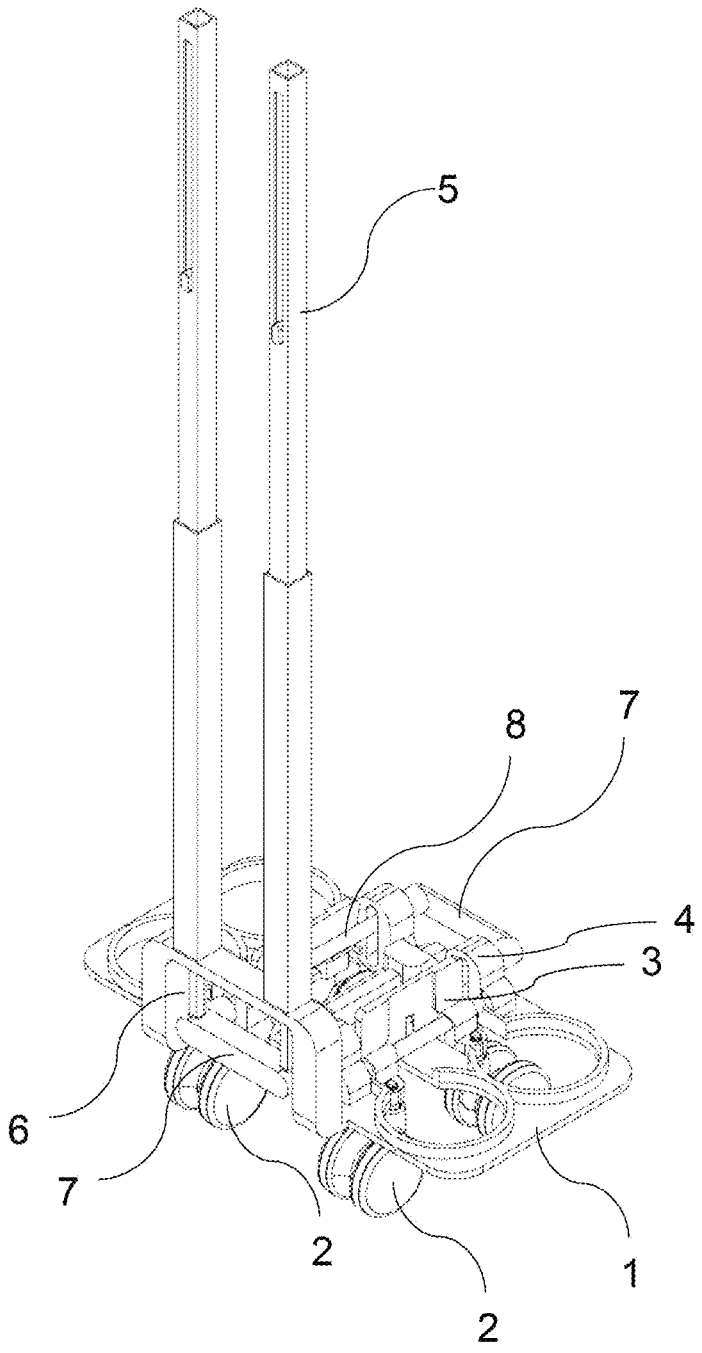
FIG. 2 is a perspective view of a mechanical system for folding and unfolding suitcase wheels in accordance with the present invention, where the wheels are unfolded.

FIG. 2 shows the mechanism when the telescopic handles have been raised, moving up the ascending tubes 6, which are attached by the ascending shafts 7 to the horizontal tubes 8 and this whole structure is now visible on its upper position as allowed by the rods 4. Now the horizontal tubes 8 can be seen in the upper section of the rods 4, and this has raised the loose part of the rotating platforms 3, pivoting it to a vertical position and therefore unfolding the wheels 2. Here, it can be seen how the wheels 2 have pivoted into their final position thanks to the rotating platforms 3 on which they are mounted. Additionally, the L-shaped system is clearly shown in action, demonstrating how, as the handle 5 is lowered, the wheels 2 smoothly and controllably return to their storage position, aided by the torsion spring as will be shown in FIG. 7.

Figure 3:
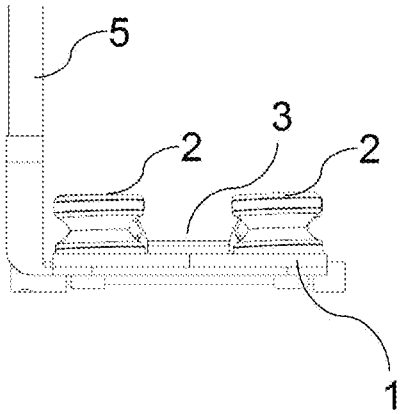
FIG. 3 is a side view of a mechanical system for folding and unfolding suitcase wheels in accordance with the present invention, where the wheels are folded.
Figure 5:
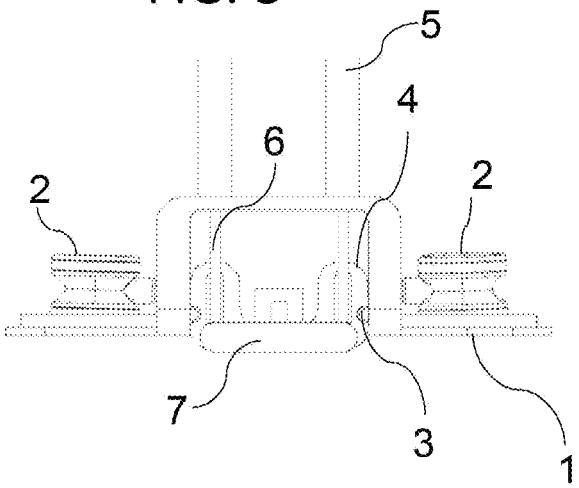
FIG. 5 is a front view of a mechanical system for folding and unfolding suitcase wheels in accordance with the present invention, where the wheels are folded.

FIG. 3 and FIG. 5 show different angles of the mechanism shown in its most compact state, with the wheels 2 folded. These views highlight how the mechanism has been designed to be as flat as possible, minimizing its impact on the suitcase's interior space. This is crucial to guarantee that the storage of the wheels does not compromise load capacity, a fundamental aspect for travelers seeking functionality without sacrificing space.

Here, it is shown how the system remains within the thickness of the wheels 2, which ensures that there are no significant protrusions when the wheels are concealed. The system activates with the telescopic handle's travel, meaning that even with minimal effort by the user when extending the handle, the wheels will automatically deploy. In this way, the closing system of the handle itself is utilized, which locks into the extended position with a "click." This system is quite strong, and it is relied upon to prevent the travel from reversing. Thus, for the wheels 2 to return to their folded position, the user only needs to release this "click" system using the handle's trigger, and, as the handle 5 begins to lower, the wheels 2 will fold back. This design is particularly efficient, as it is not only easy to use, but also ensures durability by avoiding complex or electronic systems that could fail.

Figure 4:
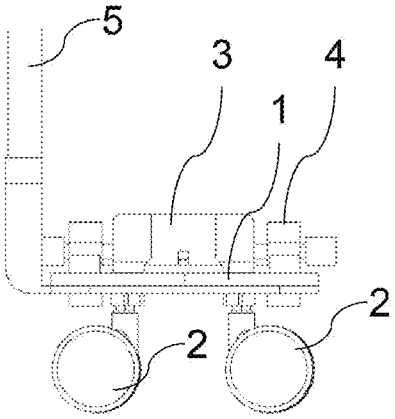
FIG. 4 is a side view of a mechanical system for folding and unfolding suitcase wheels in accordance with the present invention, where the wheels are unfolded.
Figure 6:
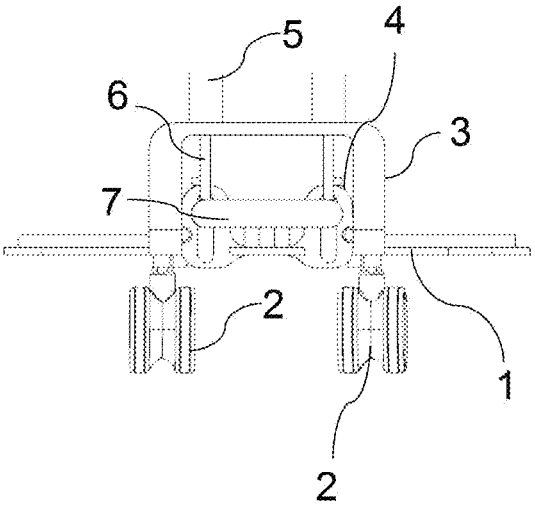
FIG. 6 is a front view of a mechanical system for folding and unfolding suitcase wheels in accordance with the present invention, where the wheels are unfolded.

FIG. 4 and FIG. 6, on the other hand, show the same two angles of the mechanism shown with the wheels unfolded (side view and front view respectively). Comparing the figures side by side, it is easy to understand how the system works, by rotating the rotating platforms 3 with the lifting of the "L-shaped module" as guided by the rods 4. The ascending shafts 7 are attached to the horizontal tubes 8 and to the ascending tubes 6. All this together goes up when the telescopic handle goes up, thus generating the pivoting of the rotating platforms 3 and the consequent deployment of the wheels 2.

Figure 7:
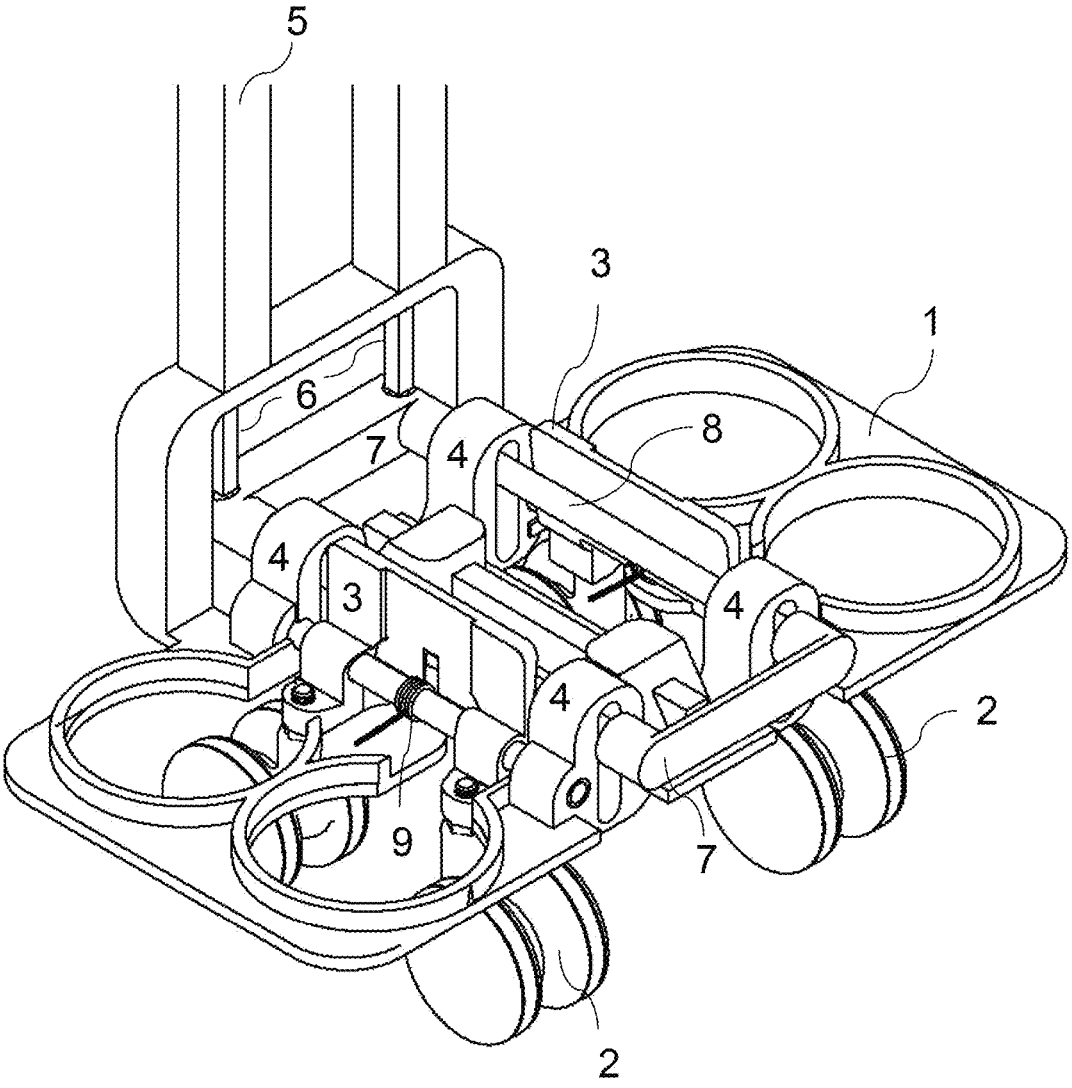
FIG. 7 is a more detailed perspective view of a mechanical system for folding and unfolding suitcase wheels in accordance with the present invention, where the wheels are unfolded.

FIG. 7 shows another perspective of the mechanism with unfolded wheels, which excellently showcases the intervening parts. This figure highlights the role of the torsion spring 9, which ensures that the wheels 2 return to their folded position when the handle 5 begins to lower. This spring 9 not only keeps the wheels 2 stable during use; it also facilitates the storage process by ensuring that the wheels 2 retract efficiently. Regular springs, elastics and other methods can be used in other embodiments without departing from the spirit and scope of the invention. Similarly, a different form of transmission can be used to convert the vertical movement of the ascending tube 6 (activated by the telescopic handle 5) into the rotating movement of the wheel rotating platform 3. This wheel rotating platform 3 does not necessarily need to have the shape of a "wing" in fact, in some embodiments, the wheels can be directly fixed to the horizontal tubes 8. In such a case, the rotation of this tube could be activated directly from the up and down movement of the ascending tube 6, for example with a pinion and rack mechanism. This modification and other possible configurations are encompassed within the spirit and scope of the invention which aims to provide a mechanical system for the folding and unfolding of the wheels with a firm and slim structure, and many variations allow for the same result.

Figure 8:
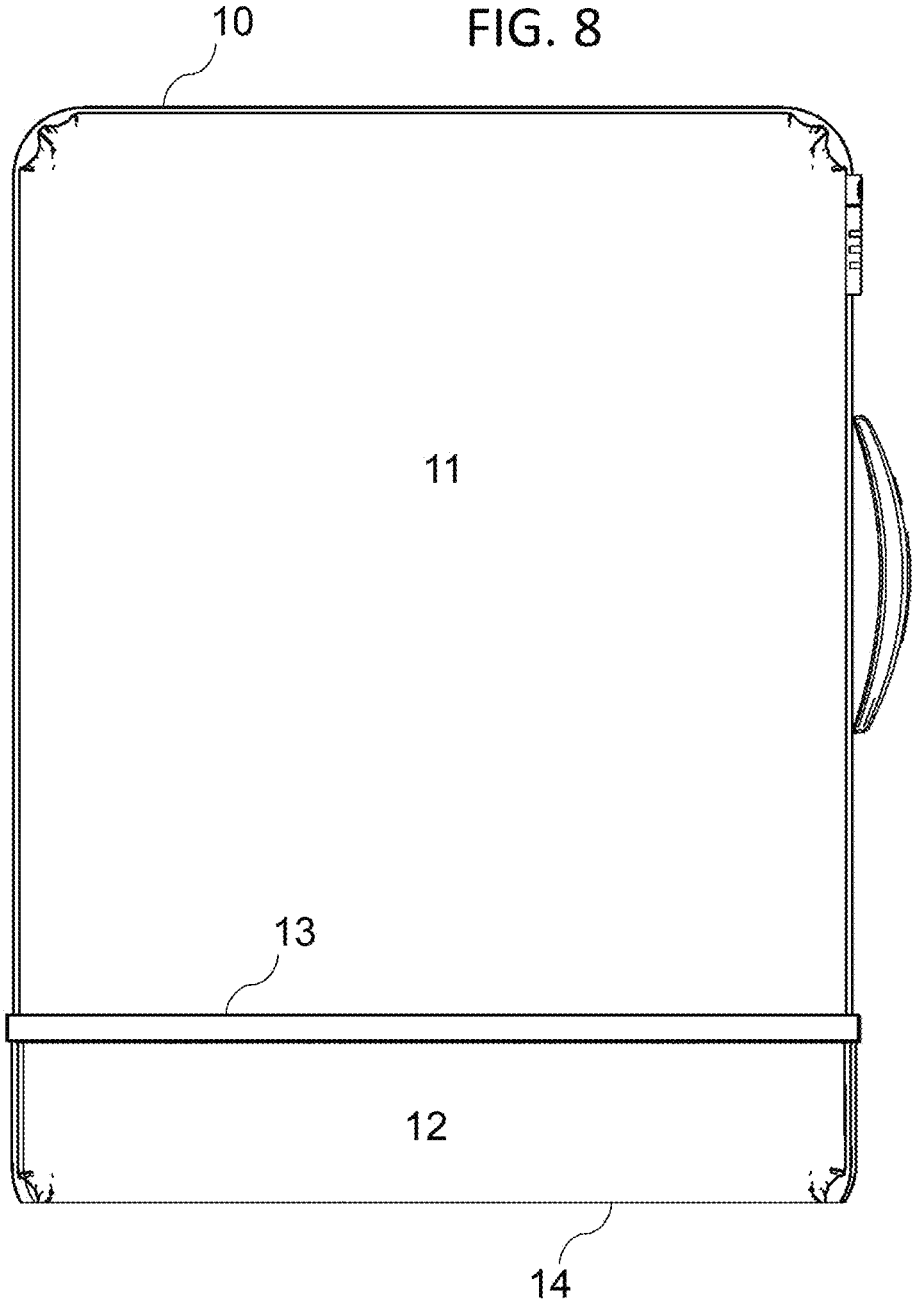
FIG. 8 is a schematic front view of a suitcase in accordance with the present invention.

FIG. 8 is a schematic front view of a suitcase 10 modified to include the mechanism. The main compartment of the suitcase 11 is separated from the lower compartment 12 by a separation wall 13. The lower compartment 12 has an open floor 14 which allows the wheels to touch the floor when the mechanism is housed within the lower compartment 12, as will be shown in the following images. In other embodiments, the open floor 14 can be equipped with a cover, provided that the cover includes openings to allow the wheels to emerge when deployed. The lower compartment 12 is designed to protect the mechanism when the wheels are not in use, ensuring that the wheels 2 remain hidden and safeguarded during suitcase handling. This feature ensures that the wheels 2 can be stored and deployed without compromising the suitcase's internal space. The system adapts to different types of suitcases, although, a priori, the system is compatible with a wide range—from hard-shell models to fabric suitcases—regardless of whether they are wider or narrower. The idea is that the mechanism can be adjusted to any model, though certain specific adaptations may be needed depending on the type of suitcase. For example, some suitcases have more rounded shapes or are made from different materials, which may require adjustments to ensure functionality.

A key aspect of the invention is that the suitcases must have a one-piece base, meaning that one side of the suitcase will be solid to provide support and conceal the mechanism, thereby ensuring that the system is not visible from the interior. Additionally, the suitcase will need to open in the middle, which is a design requirement to accommodate the retractable wheel system.

The need to keep the main body of the suitcase hermetic is essential, as there can be no holes that compromise its integrity. This aspect of the design is crucial for protecting the internal mechanism and ensuring that the suitcase maintains its storage and security properties. On the other hand, for the mechanical module to be fully functional, the suitcases will need to be designed with a lower compartment 12 where the mechanism will be installed. In this regard, suitcase manufacturers will need to adapt their models in the future to include this specific space for the mechanism. This means that the suitcases will not only have to integrate with the system but will also need to be designed from the outset with this compatibility in mind. In summary, the mechanism is versatile, but suitcase design must evolve to accommodate and function effectively with this innovative system.

Additionally, the mechanism is synchronized with the extension of the telescopic handle 5, in such a way that the wheels 2 activate automatically when the handle 5 is extended. This mechanism is closely tied to the modular concept of the system, where each component has a specific function that contributes to its durability and efficiency.

Figure 9:
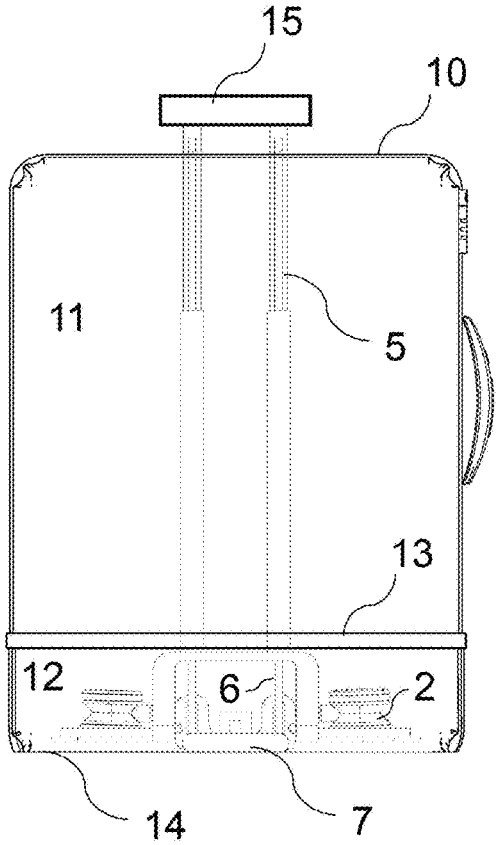
FIG. 9 is a schematic front view of a suitcase in accordance with the present invention showing inside a mechanical system for folding and unfolding suitcase wheels in accordance with the present invention, where the wheels are folded.
Figure 10:
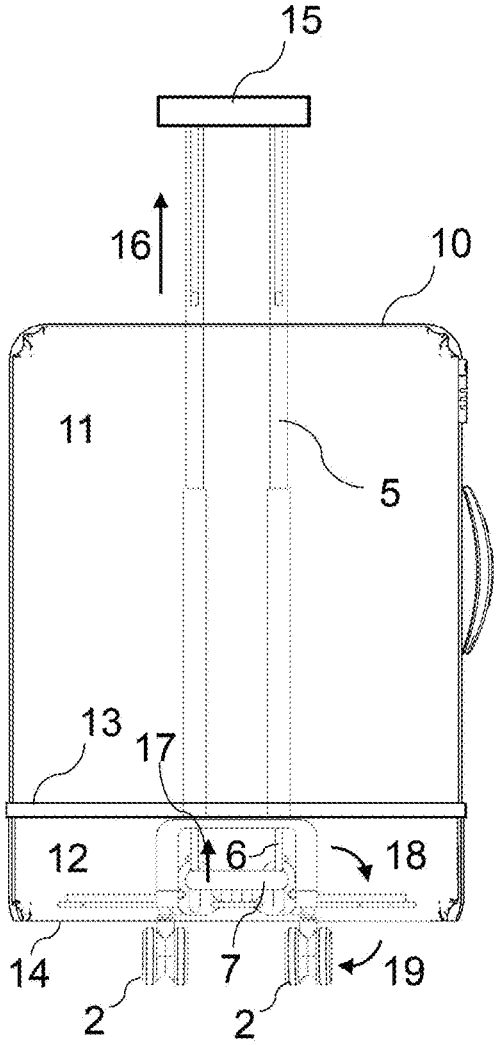
FIG. 10 is a schematic front view of a suitcase in accordance with the present invention showing inside a mechanical system for folding and unfolding suitcase wheels in accordance with the present invention, where the wheels are unfolded.

FIG. 9 and FIG. 10 show schematic front views of the modified suitcase, showing inside of them the mechanical system for folding and unfolding suitcase wheels to better understand how it is integrated. For clarity in the illustrations, the drawings depict the suitcases as if they were transparent, allowing the internal components to be visible. In FIG. 9 the wheels are folded whereas in FIG. 10 the wheels are unfolded, allowing for side-to-side comparison of both states. As can be seen in FIG. 9, when the wheels 2 are folded, the mechanism is fully integrated within the lower compartment 12 of the suitcase 10. We can see the suitcase in its fully compact state, with the wheels stored inside the lower compartment 12. The primary function of this design is to protect the wheels during transport and storage, ensuring they do not suffer damage when the suitcase is handled in environments such as airplane compartments or during airport handling. This feature not only extends the lifespan of the wheels but also enhances the overall durability of the suitcase. The system allows the wheels 2 to automatically position themselves when the telescopic handle 5 is extended, ensuring a smooth transition between folded and unfolded states. Additionally, the three-hundred-and-sixty degrees wheels enable agile and multidirectional movement, which is especially useful for navigating uneven surfaces or small spaces. Although the system is designed to be automatic, in some cases, the user may slightly lift the suitcase to facilitate the unfolding process. This figure shows how the wheel mechanism remains hidden, and how it activates simply and efficiently, making it easy for the user to deploy the wheels without complications.

FIG. 10, as said before, shows a schematic front view of the modified suitcase, showing inside of it the mechanical system for folding and unfolding suitcase wheels with the wheels unfolded. In it, arrows 16, 17, 18 and 19 have been added to represent the motions of the parts. When the handle 15 is raised, as shown by arrow 16, the telescopic handle 5 is raised too, activating the movement of the ascending tube 6, as shown by arrow 17. This movement pivots the rotating platform 3, in a rotating movement represented by arrow 18, and this at the same time rotates the wheels 2 positioning them in their unfolded position as represented by arrow 19. As can be seen in this figure, the wheels 2, now unfolded, are outside of the lower compartment 12, extending outward through the open floor 14 of the lower compartment 12. This figure highlights the importance of adjusting the distance between the wheels for each type of suitcase. This feature is essential to ensure that the system remains functional and stable in suitcases of different sizes and shapes.

In the modular design of the present invention, the wheel mechanism deploys simultaneously on both sides, ensuring that the wheels align correctly without the need for additional adjustments by the user. This not only improves the functionality of the system but also makes it easier to use, as the user does not need to worry about activating each wheel individually. The flexibility of this design is essential for the system to be integrated into a wide variety of suitcases, as mentioned before.

Figure 11:
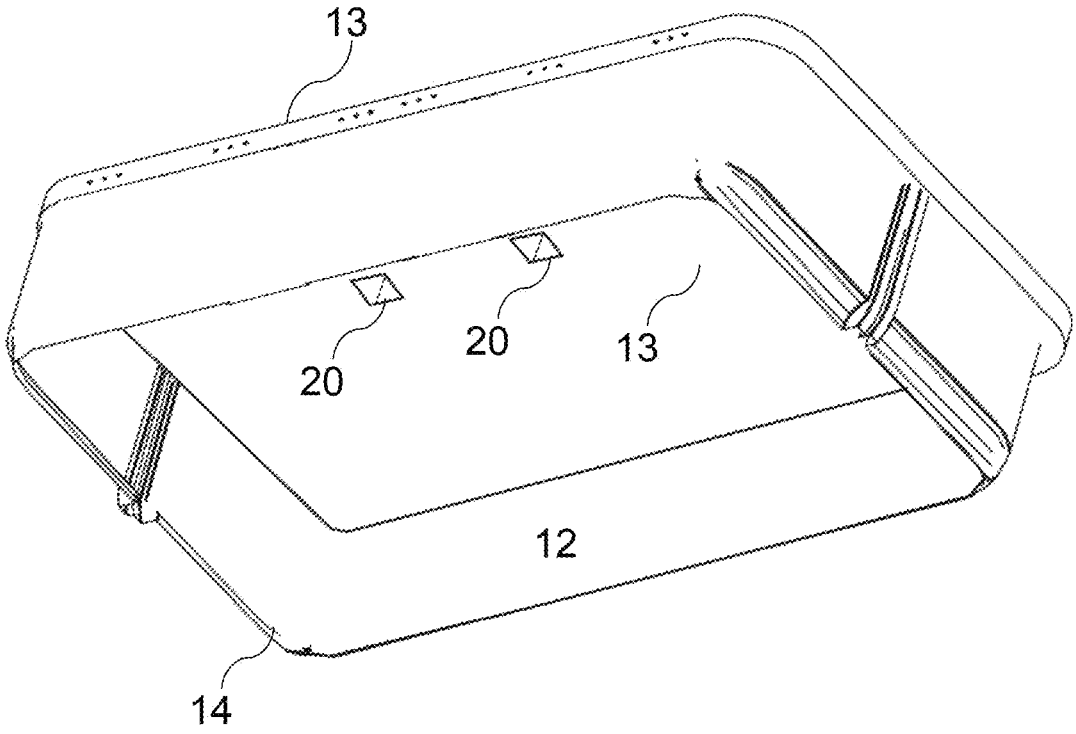
FIG. 11 is a perspective view of the lower compartment of a suitcase in accordance with the present invention.

Lastly, FIG. 11 shows the lower compartment 12 of a suitcase in accordance with the present invention. As it can be seen in the image, the separating wall 13 divides this compartment from the main body 11 of the suitcase, but it has two holes 20 so that the telescopic handles 5 can fit though them. It is essential to ensure that these telescopic handles 5 fit tightly inside the holes 20 so that there are no gaps allowing small objects to fall from the main body 11 to the lower compartment 12 and eventually to the floor.

The description as set forth is not intended to be exhaustive or to limit the invention to the precise form disclosed. Many modifications and variations are possible in light of the teachings above without departing from the spirit and scope of the forthcoming claims.

The invention claimed is:

1. A mechanical system comprising:

a) a telescopic handle operable in an up-and-down motion;

b) at least four wheels;

c) at least two pivotable rotating platforms wherein two wheels are mounted on each of the two rotating platforms, such that each rotating platform pivots to fold or unfold its corresponding pair of wheels;

d) a transmission mechanism configured to convert the vertical motion of the telescopic handle into a rotational motion of the rotating platforms;

e) a frame to support the wheels, the rotating platforms and the transmission mechanism; and f) a spring system configured to return the rotating platforms and wheels to a folded position when the telescopic handle is lowered;

wherein the transmission mechanism enables the folding and unfolding of the wheels in response to the up-and-down motion of the telescopic handle; and wherein said transmission mechanism comprises:

a) two ascending tubes, each connected to the telescopic handle;

b) two horizontal tubes forming two L-shaped modules with the ascending tubes;

c) two ascending shafts connecting both L-shaped modules on both ends of the horizontal tubes; and d) two rods acting as guides for the horizontal tubes to ensure a controlled vertical motion;

and wherein the ascending tube, upon lifting, pivots the rotating platforms to rotate the wheels into an unfolded position, and upon lowering, the spring system facilitates their return to a folded position.

2. A suitcase comprising:

a) a main body;

b) a lower compartment separated from the main compartment by a separation wall, the lower compartment having an open floor and said separation wall having two holes;

c) a telescopic handle operable in an up-and-down motion, airtightly traversing the separation wall holes;

d) a mechanical system comprising four wheels and two rotating platforms, with two wheels mounted on each of the two rotating platforms, such that each rotating platform pivots to fold or unfold its corresponding pair of wheels, two ascending tubes, each connected to the telescopic handle, two horizontal tubes forming two L-shaped modules with the ascending tubes, two ascending shafts connecting both L-shaped modules on both ends of the horizontal tubes, two rods acting as guides for the horizontal tubes to ensure a controlled vertical motion, a frame to support the wheels, the rotating platforms, the L-shaped modules and the rods, and a spring system configured to return the rotating platforms and wheels to a folded position when the telescopic handle is lowered;

wherein the mechanical system is fully housed within the lower compartment of the suitcase, such that when the wheels are folded, said wheels remain concealed inside the lower compartment, and when unfolded, said wheels extend outward through the open floor of the lower compartment to make contact with ground;

and wherein the mechanical system enables the folding and unfolding of the wheels in response to the up-and-down motion of the telescopic handle.

* * * * *